US006268118B1

(12) United States Patent
Iwasaki et al.

(10) Patent No.: US 6,268,118 B1
(45) Date of Patent: Jul. 31, 2001

(54) PHOTOSENSITIVE EMULSION, THERMALLY DEVELOPABLE PHOTOSENSITIVE MATERIAL CONTAINING THE SAME, IMAGE RECORDING METHOD AND IMAGE FORMING METHOD EMPLOYING THE SAME

(75) Inventors: Keiko Iwasaki; Tetsuo Shima, both of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/444,987

(22) Filed: Nov. 22, 1999

(30) Foreign Application Priority Data

Nov. 25, 1998 (JP) ..... 10-334194
Dec. 15, 1998 (JP) ..... 10-356208

(51) Int. Cl.[7] ..... G03L 1/498
(52) U.S. Cl. ..... 430/619; 430/620
(58) Field of Search ..... 430/619, 620, 430/617

(56) References Cited

U.S. PATENT DOCUMENTS 3,634,083 * 1/1972 Berman .
5,051,335 * 9/1991 Kato ..... 430/203

FOREIGN PATENT DOCUMENTS 0754969 1/1997 (EP) .
0952481 10/1999 (EP) .
0962812 12/1999 (EP) .

OTHER PUBLICATIONS

European Search Report EP99 30 9385.

* cited by examiner

*Primary Examiner*—Thorl Chea
(74) *Attorney, Agent, or Firm*—Jordan B. Bierman; Bierman, Muserlian and Lucas

(57) ABSTRACT

Disclosed is a thermally developable photosensitive material having a photosensitive layer comprising a photosensitive silver halide, an organic silver salt, a reducing agent, and a binder, a thermally developable photosensitive material the organic silver salt comprises tabular organic silver salt grains having an aspect ratio of at least 3, and average of needle ratio of the tabular organic silver salt grains measured from principal plane direction is not less than 1.1 and less than 10. The thermally developable photosensitive material exhibits high sensitivity as well as low fog and an image forming method employing the same.

21 Claims, No Drawings

PHOTOSENSITIVE EMULSION, THERMALLY DEVELOPABLE PHOTOSENSITIVE MATERIAL CONTAINING THE SAME, IMAGE RECORDING METHOD AND IMAGE FORMING METHOD EMPLOYING THE SAME

FIELD OF THE INVENTION

The present invention relates to a photosensitive emulsion, thermally developable material containing the emulsion as well as to an image recording method an image forming method employing said thermally developable material.

BACKGROUND OF THE INVENTION

Conventionally, in printing plate making and medical fields, effluent generated by wet processing of image forming materials has been concerned from the ease of work. Recently, a decrease in the processing effluent has been strongly demanded from the viewpoint of environmental protection as well as saving of floor space. Accordingly, needed has been the development of techniques regarding light/heat sensitive photographic materials which can be subjected to efficient exposure employing a laser image setter as well as a laser imager and can form sharp and clear black-and-white images of high resolution.

As techniques to meet those requirements, thermally developable materials for preparing photographic images employing thermal development methods are disclosed in, for example, U.S. Pat. Nos. 3,152,904 and 3,457,075, and D. Morgan and B. Shely, "Thermally Processed Silver Systems" in "Imaging Processes and Materials", Neblette, 8th edition, edited by Sturge, V. Walworth, A Shepp, page 2, 1969.

The feature of these thermally developable materials is that images are formed by thermal development, generally at 80 to 140° C. employing reducing agents incorporated into the photosensitive layer, and the fixing step is eliminated. However, in the above-cited thermally developable materials, image problems have tended to occur because normal image formation is locally hindered due to the presence of silver halide and organic silver coagula.

On the other hand, when silver halides or organic silver salts are forcibly disperse-pulverized by employing a homogenizer, problems occur in which fog increases, sensitivity decreases, and image quality deteriorated. Therefore, techniques have been demanded which are capable of yielding greater light sensitivity as well as higher density without an increase in the silver amount, while decreasing fog.

SUMMARY OF THE INVENTION

An object of the present invention is to provide a thermally developable material, and in detail to provide a thermally developable material and an image forming method which exhibit high sensitivity, reduced image deffects as well as low fog.

The present invention and the embodiment thereof are described below.

A thermally developable photosensitive material having a photosensitive layer comprising a photosensitive silver halide, an organic silver salt, a reducing agent and a binder, wherein the organic silver salt comprises tabular organic silver salt grains having an aspect ratio of at least 3, and average of needle ratio of the tabular organic silver salt grains measured from principal plane direction is not less than 1.1 and less than 10.

In the thermally developable photosensitive material described above, the organic silver salt comprises at least 80% by number of tabular organic silver salt grains having an aspect ratio of at least 3, and average of needle ratio of the tabular organic silver salt grains measured from principal plane direction is not less than 1.1 and less than 5.0.

The aspect ratio of the tabular organic silver salt grains is preferably 3 to 20, more preferably 3 to 10.

The ratio of organic silver salt grains which have a projection area of no more than 0.025 $\mu m^2$ is preferably at least 70 percent of the total projection area. The ratio of grains which have a projection area of at least 0.2 $\mu m^2$ is preferably not more than 10 percent of the total projection area appeared in a perpendicular cross section of the support surface of said photosensitive material observed by an electron microscope.

The photosensitive layer preferably comprises zirconium in an amount of 0.01 to 0.5 mg per g of silver, more preferably 0.01 to 0.3 mg per g of silver.

The silver salt has preferably monodisperse grain size distribution.

The monodisperse degree of the silver salt grains is preferably 1 to 30%.

The whole amount of silver is preferably 2.4 g/$m^2$ or lower, more preferably 0.5 to 2.4 g/$m^2$ as converted silver.

The average grain diameter of the organic silver salt is preferably 0.01 to 0.8 $\mu$m, more preferably 0.05 to 0.5 $\mu$m.

The average grain size of silver halide is preferably 0.01 to 0.1 $\mu$m.

The preferable reducing agent is a hindered phenol compound.

The content of the total solvents contained in the thermally developable photosensitive material is 5 to 1000 mg/$m^2$, more preferably 10 to 300 mg/$m^2$.

The photosensitive emulsion comprising a photosensitive silver halide and an organic silver salt in which the organic silver salt comprises tabular organic silver salt grains having an aspect ratio of at least 3, and average of needle ratio of the tabular organic silver salt grains measured from principal plane direction is not less than 1.1 and less than 10.

In the photosensitive emulsion the organic silver salt preferably comprises at least 80% by number of tabular organic silver salt grains having an aspect ratio of at least 3, and average of needle ratio of the tabular organic silver salt grains measured from principal plane direction is not less than 1.1 and less than 5.0.

A photosensitive emulsion preferably comprises zirconium in an amount of 0.01 to 0.5 mg per g of silver.

DETAILED DESCRIPTION OF THE INVENTION

The present invention will be detailed below.

A photosensitive emulsion comprises an organic silver salt, photosensitive silver halide and a solvent, and the photosensitive layer comprises zirconium in an amount of 0.01 to 0.5 mg per g of silver. A particularly preferred case is one in which said photosensitive layer comprises zirconium in an amount of 0.01 to 0.3 mg.

An organic silver salt employed in the present invention is described.

In the present invention the organic silver salt has preferably monodisperse grain size distribution. The monodispersed grains as described herein are the same as the case for silver halides, and said monodisperse degree is preferably 1 to 30%.

The average grain diameter of the organic silver salt is preferably 0.01 to 0.8 μm, and is more preferably 0.05 to 0.5 μm.

The average grain size is average of the diameter of circle having same area of respective grains observed by microscope.

The organic silver salt comprises tabular grains preferably have an aspect ratio of at least 3, and the number average of the needle ratio of said grains measured from the principal plane direction is not less than 1.1 and less than 10, more preferably not less than 1.1 and less than 5. The grains having an aspect ratio of at least 3 is denoted that number of grains satisfying aspect ratio of at least 3 occupies not less than 50% by number.

The organic silver salts employed in the present invention preferably comprise tabular organic silver salt grains of at least 60 percent (in number) of the entire organic silver salts, more preferably at least 70 percent (in number), and most preferably at least 80 percent (in number).

The aspect ratio of the above-mentioned tabular organic silver salt grains is obtained employing procedures described below.

AR=grain diameter (in μm)/Thickness (in μm)

The aspect ratio (AR) of the tabular organic silver salt grains employed in the present invention is preferably 3 to 20, and more preferably 3 to 10. The above-mentioned range is considered to be the preferred one, based on the following criteria. When the aspect ratio is too small, organic silver salt grains are likely close packed. When it is too large, organic silver salt grains likely overlap each other, and are likely dispersed while adhering to each other. As a result, light scattering etc. tend to occur and the visual transparency of photosensitive materials tends to decrease.

In the present invention, the above-mentioned tabular organic silver salt grains preferably have small anisotropy in the shape of two planes i.e., principal planes, having a maximum area, which are arranged nearly parallel so that grains are more suitable for packing in the photosensitive layer. Specifically, the number average of the needle ratio of said grains measured from the principal plane direction is preferably not less than 1.1 and less than 10 and more preferably not less than 1.1 and less than 5.

The number average of the needle ratio of the above-mentioned tabular organic silver salt grains is obtained employing procedures described below.

First, a photosensitive layer, comprising tabular organic silver salt grains, is allowed to swell by employing an organic solvent which is capable of dissolving the binder of said photosensitive layer, and said layer is then peeled from the support. The operation is repeated five times, in which the peeled layer is subjected to ultrasonic cleaning with the above-mentioned solvent, and centrifugal separation, and the supernatant is removed. Further, the above-mentioned process is carried out under a photographic safelight.

Subsequently, dilution is carried out employing MEK (methyl ethyl ketone) so that the concentration of the organic silver solid portion becomes 0.01 percent. After carrying out ultrasonic dispersion, the resulting is dropped onto a polyethylene terephthalate film which has been subjected to make hydrophilic employing a glow discharge, and is subsequently dried.

The film, on which said grains are placed, is subjected to oblique evaporation of 3 nm thickness Pt-C by an electron beam from 30° angle against the film surface employing a vacuum evaporation unit, and thereafter, is preferably employed for observation.

Details of others such as electron microscopic technology and sample preparation techniques can be had by referring to "Igaku·Seibutugaku Denshikenbikyo Kansatsuho (Medical and Biological Electron Microscopy", edited by Nippon Denshikenbikyo Gakkai, Kanto Shibu, (Maruzen), and "Denshikenbikyo Seibutsu Shiryo Sakuseiho (Preparation Method of Biological Samples for Electron Microscopy)", edited by Nippon Denshikenbikyo Gakkai, Kanto Shibu, (Maruzen).

The prepared sample is observed through a secondary electron image, obtained by employing a field emission scanning electron microscope (hereinafter referred to as PE-SEM) under a magnification of 5,000 to 20,000 at an acceleration voltage of 2 to 4 kV, and the resulting image is stored in suitable recording media.

For the above-mentioned processing, it is convenient to use a device, which is capable of directly recording onto memory data as digital information, which are obtained by AD converting image signals from the electron microscope body. However, analogue images recorded onto Polaroid film etc. can be converted to digital images employing a scanner etc., and the resulting images may be employed upon carrying out shading correction, enhancement of contrast, as well as on the edges, etc. if desired.

One image recorded in a suitable medium is decomposed to at least 1024×1024 pixels and is preferably decomposed to 2048×2048 pixels. Said decomposed image is preferably subjected to image processing employing a computer.

Procedures of the above-mentioned image processing are as follows. First, a histogram is prepared and portions corresponding to organic silver salt grains are extracted employing binary processing. Inevitably coagulated grains are cut employing a suitable algorithm or a manual operation and are subjected to boarder extract. Thereafter, both maximum length (MX LNG) and minimum width between two parallel lines (WIDTH) are measured for at least 1000 grains, and the needle ratio of each grain is obtained employing the formula described below. The maximum length (MX LNG) is a maximum value of straight length between two points within a grain. The minimum width between two parallel lines is a minimum distance of two parallel lines drawn circumscribing the grain.

Needle ratio=(MX LNG)/(WIDTH)

After that, the number average of the needle ratio is calculated regarding all measured particles. When measurements are carried out employing the above-mentioned procedures, it is desirable that in advance, employing a standard sample, the length correction (scale correction) per pixel as well as two-dimensional distortion correction of the measurement system is sufficiently carried out. As the standard sample, Uniform Latex Particles (DULP) marketed by Dow Chemical Co. in the USA are suitable. Polystyrene particles having a variation coefficient of less than 10 percent for a diameter of 0.1 to 0.3 μm are preferred. Specifically, a type having a particle diameter of 0.212 μm as well as a standard deviation of 0.0029 μm is available on the market.

Details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

Methods to prepare organic silver salt grains having the above-mentioned shape are not particularly restricted. The optimization of various conditions such as keeping the mixing state well during the formation of an organic acid alkali metal salt soap and/or the mixing state during the addition of silver nitrate to said soap. After tabular organic silver salt grains employed in the present invention are preliminarily dispersed together with binders, surface active agents, etc., if desired, the resulting mixture is preferably dispersed and pulverized by a media homogenizer, a high pressure homogenizer, or the like. During said preliminary dispersion, ordinary stirrers such as an anchor type, a propeller type, etc., a high speed rotation centrifugal radial type stirrer (Dissolver), as a high speed shearing stirrer (homomixer) may be employed.

Furthermore, employed as said media homogenizers may be rolling mills such as a ball mill, a satellite ball mill, a vibrating ball mill, medium agitation mills such as a bead mill, atriter, and others such as a basket mill. Employed as high pressure homogenizers may be various types such as a type in which collision occurs against a wall or a plug, a type in which liquid is divided into a plurality of portions and said portions are subjected to collision with each other, a type in which liquid is forced to pass through a narrow orifice, etc.

Examples of ceramics employed as the ceramic beads include Al2O3, BaTiO3, SrTiO3, MgO, ZrO, BeO, Cr2O3, SiO3, SiO2-Al2O3, Cr2O3-MgO, MgO-CaO, MoO-C, MgO-Al2O3 (spinel), SiC, TiO2, K2O, Na2O, BaO, PbO, B2O3, BeAl2O4, Y3Al5O12, ZrO2-Y2O3 (cubic zirconia), 3BeO-Al2O3-6SiO2 (artificial emerald), C (artificial diamond), SiO2-nH2O, silicone nitride, yttrium-stabilized-zirconia, zirconia-reinforced-alumina. Yttrium-stabilized-zirconia and zirconia-reinforced-alumina are preferably employed in view that little impurity is generated by friction against beads or classifier during classifying among these. The ceramics containing zirconia is called as zirconia in abbreviation.

In devices employed for dispersing the tabular organic silver salt grains employed in the present invention, preferably employed as the members which are in contact with said organic silver salt grains are ceramics such as zirconia, alumina, silicone nitride, boron nitride, or diamond. Of these, zirconia is the one most preferably employed.

During carrying out of the above-mentioned dispersion, the binder is preferably added so as to make the concentration of 0.1 to 10 wt % with reference to the weight of the organic silver salt, and temperature is preferably maintained not to be lower than 45° C. from the preliminary dispersion to main dispersion process. Example of the preferable operation conditions of a homogenizer, when employing high-pressure homogenizer as the dispersing machine, is twice or more operations with 300 to 1,000 kgf/cm$^2$. In case that the media-dispersing machine is employed, a circumferential speed of 6 to 13 m/sec. is preferable.

In case that zirconia is employed as a part of the beads or machine, it is ground and mixed to the dispersion during mixing process. This is specifically advantageous in view of photographic characteristics. Fragment of zirconia may be supplementally added to the dispersion or preliminarily added during preliminary dispersing. High concentration zirconia liquid can be obtained, for example, by circulating methylethylketone in a bead mill filled with zirconia beads. The obtained zirconia liquid may be added in adequate amount at adequate stage.

The organic silver salts are reducible silver sources and preferred are organic acids employed in the present invention, and silver salts of hetero-organic acids having a reducible silver ion source, specifically, long chain (having from 10 to 30 carbon atoms, but preferably from 15 to 25 carbon atoms) aliphatic carboxylic acids and nitrogen-containing heterocyclic rings. Organic or inorganic silver salt complexes are also useful in which the ligand has a total stability constant for silver ion of 4.0 to 10.0.

Examples of preferred silver salts are described in Research Disclosure, Items 17029 and 29963, and include the following; organic acid salts (for example, salts of gallic acid, oxalic acid, behenic acid, arachidic acid, stearic acid, palmitic acid, lauric acid, etc.); carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.)), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene)), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides.

In the present invention, of these, the preferred organic silver salts are silver behenate, silver arachidate, and/or silver stearate.

Organic silver salts are obtained by mixing a water-soluble silver compound with a compound forming a complex with silver, and preferably employed are a normal mixing method, a reverse mixing method, a double-jet method, as well as a controlled double-jet method as described in Japanese Patent Publication Open to Public Inspection No. 9-127643, etc.

Specifically, after preparing an organic acid alkali metal salt soap (for example, sodium behenate, sodium arachidate, etc.) by adding an alkali metal salt (for example, sodium hydroxide, potassium hydroxide, etc.) to an organic acid, silver nitrate is added to said soap to prepare crystals of an organic silver salt. At that time, silver halide grains may be mixed. A series of the above-mentioned reaction processes should be carried out while sufficient stirring, employing a suitable stirring member, so that the mixture in the reaction vessel becomes uniform.

The organic silver salt grains, employed in the present invention, are defined to be in a state of minimal coagula as well as uniform distribution in a thermally developable material, when through observing a perpendicular cross section of the support surface employing an electron microscope, the ratio of organic silver salt grains which have a projection area of no more than 0.025 $\mu m^2$ is at least 70 percent of the total projection area, and the ratio of grains which have a projection area of at least 0.2 $\mu m^2$ is no more than 10 percent of the total projection area.

The projection area of organic silver grains having the specified projection area as described above, its ratio in the total projection area, etc. may be calculated by a method employing a TEM (transmission electron microscope) as described below.

First, a photosensitive layer, coated onto a support, is pasted onto a suitable holder employing an adhesive and is cut perpendicular to the support surface employing a diamond knife to prepare an ultra-thin slice so as to have thickness of 0.1 to 0.2 $\mu m$.

The prepared ultra-thin slice is held by a copper mesh, and is placed onto a carbon film, which has been subjected to be hydrophilic employing a glow discharge. Then, while cooling the resulting slice to no more than −130 ° C., the image in a bright visual field is observed at a magnification of 5,000 to 40,000 times employing a transmission electron microscope (hereinafter referred to as TEM), and then images are quickly recorded employing an image plate, a CCD camera, etc. At the same time, it is recommended to suitably select a portion of said slice, which has neither been torn nor distorted in the visual field for observation.

The carbon film, which is supported by an organic film such as an extremely thin collodion, Formvar, etc., is preferably employed, and a film composed of only carbon, which is obtained by forming the film on a rock salt substrate and then dissolving away the substrate or by removing the above cited organic film, employing an organic solvent or ion etc.hing, is more preferably employed.

The acceleration voltage of said TEM is preferably 80 to 400 kV, and is most preferably 80 to 200 kV.

Details of other means such as electron microscopic technology and sample preparation techniques can be referred to "Igaku·Seibutsugaku Denshikenbikyo Kansatsuho (Medical and Biological Electron Microscopy", edited by Nippon Denshikenbikyo Gakkai, Kanto Shibu, (Maruzen), and "Denshikenbikyo Seibutsu Shiryo Sakuseiho (Preparation Method of Biological Samples for Electron Microscopy)", edited by Nippon Denshikenbikyo Gakkai, Kanto Shibu, (Maruzen).

TEM image, recorded in an appropriate medium, is decomposed to at least 1024×1024 pixels or preferably at least 2048×2048 pixels, and is then subjected to image processing employing a computer. In order to carry out image processing, an analogue image recorded on a film strip is converted into a digital image employing a scanner etc., and the resulting image is preferably subjected to shading correction, contrast-edge enhancement, etc., based on specific requirements. Thereafter, a histogram is prepared and the portions corresponding to organic silver are extracted employing binary processing. At the time, coagulum of silver is regarded as one grain and is processed. The area of each grain is then obtained. In the same manner as above, the area is obtained for each of at least 1,000 grains and preferably 2,000 grains. Each area is classified into three groups, that is, A: less than 0.025 $\mu m^2$, B: between not less than 0.025 and less than 0.2 $\mu m^2$, and C: not less than 0.2 $\mu m^2$. The photosensitive material of the present invention satisfies conditions in which the total area of grains belonging to A Group is at least 70 percent of all measured grains and the total area of grains belonging to Group C is no more than 10 percent of all measured grains.

When measurements are carried out according to the above-mentioned procedure, it is preferred that employing a standard sample, correction (scale correction) of length per pixel as well as correction for two-dimensional distortion of the measurement system is sufficiently carried out previously. As the standard sample, Uniform Latex Grains (DULP), which is commercially available from Dow Chemical Co. in the USA, is appropriate. Polystyrene grains having a variation coefficient of less than 10 percent compared to a grain diameter of 0.1 to 0.3 $\mu m$ are preferred. Specifically, it is possible to obtain a type having a grain diameter of 0.212 $\mu m$ and a standard deviation of 0.0029 $\mu m$.

Details of image processing technology may be referred to "Gazoshori Oyogijutsu (Applied Technology in Image Processing)", edited by Hiroshi Tanaka, (Kogyo Chosa Kai). Image processing programs or apparatuses are not particularly limited, if the above-mentioned operation is possible. Cited as one example is Luzex-III manufactured by Nireko Co.

The photosensitive silver halide is described.

The photosensitive silver halide functions as a light sensor.

In order to minimize translucence after forming an image, and also to obtain excellent image quality, the smaller the average grain size of photosensitive silver halide grains, the more preferred it is. The average grain size is preferably not more than 0.1 $\mu m$, is more preferably 0.01 to 0.1 $\mu m$, and is most preferably 0.02 to 0.08 $\mu m$. The grain size as described herein denotes the diameter of the circle (circle equivalent diameter) having the same area as each of various grains observed with an electron microscope. Furthermore, silver halides are preferably in monodispersed grains. Said monodispersed grains as described herein mean that the monodisperse degree obtained by the formula described below is no more than 40 percent. The monodisperse degree is more preferably no more than 30 percent, and is most preferably no more than 20 percent.

Monodisperse degree=(Standard deviation of grain diameter)/(Average of grain diameter)×100

The shape of silver halide grains is not particularly limited, however the higher the Miller index [100] plane occupying ratio, the more preferred it is. Such a ratio is preferably at least 50 percent, is more preferably at least 70 percent, and is most preferably at least 80 percent. The ratio of the Miller index [100] plane may be obtained based on T. Tani, J. Imaging Sci., 29, 165 (1985), which utilizes adsorption dependence of [111] and [100] planes during adsorption of sensitizing dyes.

Another preferred shape of silver halides is a tabular grain. Said tabular grain as described herein denotes one in which the aspect ratio, r/h, is at least 3, wherein "r" (in $\mu m$) represents the grain diameter obtained as the square root of the projection area, and "h" (in $\mu m$) represents the thickness in the perpendicular direction. The aspect ratio is preferably 3 to 50. Furthermore, the grain diameter is preferably not more than 0.1 $\mu m$, and is more preferably 0.01 to 0.08 $\mu m$. These tabular grains are described in U.S. Pat. Nos. 5,264,337, 5,314,798, and 5,320,958, by which means desired tabular grains may be readily prepared.

The halogen composition is not particularly restricted, and any of the following compounds may be employed; silver chloride, silver chlorobromide, silver bromide, silver iodobromide, and silver iodide. The photographic emulsions employed in the present invention may be prepared by employing methods described in P. Glafkides, "Chimie et Physique Photographique" (published by Paul Montel Co., 1967), G. F. Duffin, "Photographic Emulsion Chemistry" (published by The Focal Press, 1966), V. L. Zelikman et al., "Making and Coating Photographic Emulsion" (published by The Focal Press, 1964), etc. Namely, any of several methods may be employed, such as an acid method, a neutral method, an ammonia method, etc. Furthermore, to allow water-soluble silver salts to react with water-soluble halides, employed may be any of the several common methods such as a single-jet method, a double-jet method, combination thereof, etc.

The silver halides employed in the present invention preferably comprise ions of metals, which belong to Groups 6 through 11 of the Periodic Table. Preferred as the above cited metals are W, Fe, Co, Ni, Cu, Ru, Rh, Pd, Re, Os, Ir, Pt, and Au. Of these, when employed in photographic materials for making printing plates, it is preferred to select from Rh, Re, Ru, Ir, and Os.

These metal ions may be incorporated into silver halides in the form of metal complexes or complex ions. Preferred as these metal complexes or metal complex ions are six-coordinate metal complexes represented by the general formula described below.

General Formula $[ML_6]^m$

In the formula M represents a transition metal selected from elements in Groups 6 through 11 of the Periodic Table; L represents a ligand, and m represents 0, -, 2-, 3-, or 4-. Specific examples of ligands represented by L include halides (fluorides, chlorides, bromides, and iodides), cyanides, cyanates, thiocyanates, selenocyanates, tellurocyanates, azides and each ligand of aquo, nitrosyl, thionitrosyl, etc. Preferred are aquo, nitrosyl, thionitrosyl, etc. When an aquo ligand is present, one or two are preferably coordinated. L may be the same or different.

Particularly preferred examples of M include rhodium (Rh), ruthenium (Ru), rhenium (Re), and osmium (Os).

Specific examples of transition metal complex ions are shown below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[Ru(NO)Cl_5]^{2-}$
8: $[RuBr_4(H_2O)]^{2-}$
9: $[Ru(NO)(H_2O)Cl_4]^{-}$
10: $[RhCl_5(H_2O)]^{2-}$
11: $[Re(NO)Cl_5]^{2-}$
12: $[Re(NO)(CN)_5]^{2-}$
13: $[Re(NO)Cl(CN)_4]^{2-}$
14: $[Rh(NO)_2Cl_4]^{-}$
15: $[Rh(NO)(H_2O)Cl_4]^{-}$
16: $[Ru(NO)(CN)_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$

These metal ions, metal complexes or metal complex ions may be employed individually or in combination of two or more of the same types of metals or of different types of metals. The content of these metal ions, metal complexes, or metal complex ions is preferably $1\times10^{-9}$ to $1\times10^{-2}$ mole per mole of silver halide, and is more preferably $1\times10^{-8}$ to $1\times10^{-4}$ mole per mole of silver halide. Compounds which provide these metal ions or complex ions are added during the formation of silver halide grains and are preferably incorporated into the interior of said silver halide grains. They may be added during any stage of the preparation of silver halide grains such as nucleation, growth, physical ripening, before or after chemical ripening, but are preferably added during the nucleation, growth and physical ripening. Further, they are more preferably added during the nucleation and growth, and are most preferably added during the nucleation. A solution containing those metal ions or complex ions may be divided into several portions and said divided portions may be added in a specified sequence. They may be incorporated into silver halide grains so that their concentration is uniform in the grain. On the other hand, they may be incorporated into silver halide grains so the their concentration in said silver halide grain exhibits a specific distribution, as described in Japanese Patent Publication Open to Public Inspection Nos. 63-29603, 2-306236, 3-167545, 4-76534, 6-110146, 5-273683, etc.

Preferably, they may be incorporated into silver halide grains so that their concentration in the grain exhibits a specific distribution. These metal compounds may be dissolved in water or suitable organic solvents (for example, alcohols, ethers, glycols, ketones, esters, amides, etc.) and added. Exemplified addition methods include those in which a solution, prepared by dissolving a metal compound powder in water or prepared by dissolving a metal compound in water together with NaCl and KCl , is added to a water-soluble silver salt solution or a water-soluble halide solution which is undergoing grain formation; when a silver salt solution and a halide solution are mixed employing a double-jet method, a metal compound solution is simultaneously added employing a triple-jet method and silver halide grains are prepared; during said grain formation, the necessary amount of an aqueous metal compound solution is added to a reaction vessel; during the formation of silver halide, other silver halide grains which are previously doped with metal ions or complex ions are added and dissolved.

In particular, a method is preferred in which a solution, prepared by dissolving a metal compound powder in water or prepared by dissolving a metal compound in water together with NaCl and KCl, is added to a water-soluble halide solution. When added onto the surface of grains, the necessary amount of the aqueous metal compound solution may be added to a reaction vessel immediately after grain formation, during physical ripening, after physical ripening, or during chemical ripening.

In the present invention, photosensitive silver halide grains may, or may not be subjected to desalting after grain formation. If required, they may be subjected to desalting employing water wash methods known in this industry such as the noodle method, a flocculation method, etc.

The photosensitive silver halide grains employed in the present invention preferably undergo chemical sensitization. Employed as preferred chemical sensitizing methods may be a sulfur sensitizing method, a selenium sensitizing method, a tellurium sensitizing method, as well known in this industry. Furthermore, a noble metal sensitizing method which employs gold compounds, platinum compounds, palladium compounds, iridium compounds etc., and reduction sensitizing methods may be employed.

Preferably employed as compounds used for a sulfur sensitizing method, a selenium sensitizing method, and tellurium sensitizing method may be those which are known in the art, and which are described in Japanese Patent Publication Open to Public Inspection No. 7-128768. Listed as tellurium sensitizers are, for example, diacyl tellurides, bis(oxycarbonyl)tellurides, bis(carbamoyl)tellurides, diacyl tellurides, bis(oxycarbonyl)ditellurides, bis(carbamoyl) ditellurides, compounds having a P=Te bond, tellyrocarboxylic acid salts, Te-organyltellurocarboxylic acid esters, di(poly)tellurides, tellurides, tellurols, telluroacetals, tellurosulfonates, compounds having a P-Te bond, Te containing heterocycles, tellurocarbonyl compounds, inorganic tellurium compounds, colloidal tellurium, etc.

Preferably employed as compounds used for a noble metal sensitizing method are, for example, chloroauric acid, potassium chloroaurate, potassium aurithiocyanate, gold sulfide, gold selenide, compounds described in U.S. Pat. No. 2,448,060, British Patent No. 618,061, etc.

Employed as specific compounds which are used in the reduction sensitization method may be, for example, stannous chloride, aminoiminomethanesulfinic acid, hydrazine derivatives, borane compounds, silan compounds, polyamine compounds, etc., other than ascorbic acid and thiourea dioxide. Furthermore, the reduction sensitization may be carried out by ripening an emulsion while maintaining the pH at no less than 7 or the pAg at not more than 8.3. Further, the reduction sensitization may also be carried out by introducing a single additional portion of silver ions during grain formation.

A reducing agent is preferably incorporated into the thermally developable photosensitive material to which the present invention is applied. Examples of suitable reducing agents are described in U.S. Pat. Nos. 3,770,448, 3,773,512, and 3,593,863, and Research Disclosure Items 17029 and 29963, and include the following.

Aminohydroxycycloalkenone compounds (for example, 2-hydroxypiperidino-2-cyclohexane); esters of amino reductones as the precursor of reducing agents (for example, pieridinohexose reducton monoacetate); N-hydroxyurea derivatives (for example, N-p-methylphenyl-N-hydroxyurea); hydrazones of aldehydes or ketones (for example, anthracenealdehyde phenylhydrazone); phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfhydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol), UV-sensitive ascorbic acid derivatives and 3-pyrazolidones.

Of these, particularly preferred reducing agents are hindered phenols. As hindered phenols, listed are compounds represented by the general formula (A) described below.

General formula (A)

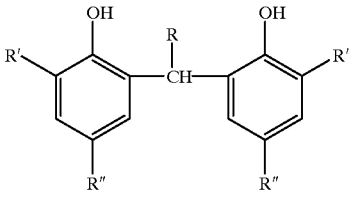

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below.

A-1

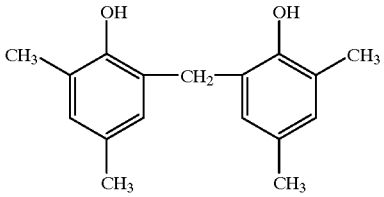

-continued

A-2

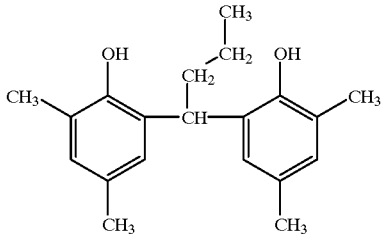

A-3

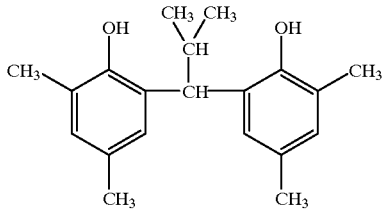

A-4

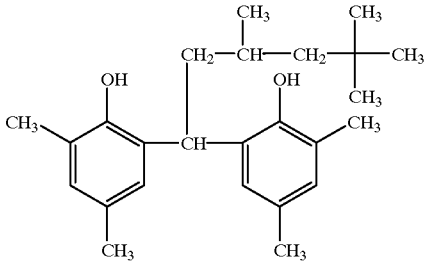

A-5

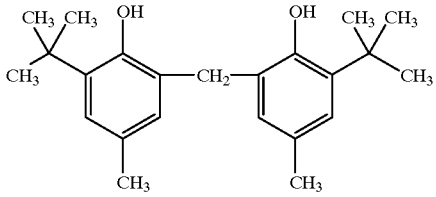

A-6

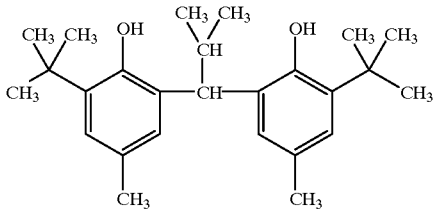

A-7

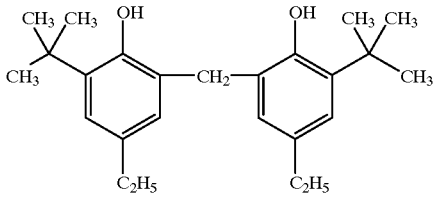

The used amount of reducing agents first represented by the above-mentioned general formula (A) is preferably $1\times10^{-2}$ to 10 moles per mole of silver, and is most preferably $1\times10^{-2}$ to 1.5 moles.

Incorporation of antifoggants into the thermally developable photosensitive material of the present invention is preferable. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred.

As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by —C(X1)(X2)(X3) (wherein X1 and X2 each represents halogen, and X3 represents hydrogen or halogen), as disclosed in U.S. Pat. Nos. 3,874,946 and 4,756,999. As examples of suitable antifoggants, employed preferably are compounds etc. described in paragraph numbers [0062] and [0063] of Japanese Patent Publication Open to Public Inspection No. 9-90550. Furthermore, more suitable antifoggants are disclosed in U.S. Pat. No. 5,028,523, and EP Nos. 600,587, 605,981, and 631,176.

Image color control agents are preferably incorporated into the thermally developable photosensitive material to which the present invention is applied. Examples of suitable image color control agents are disclosed in Research Disclosure Item 17029, and include the following;

imides (for example, phthalimide), cyclic imides, pyrazoline-5-ones, and quinazolinon (for example, succinimide, 3-phenyl-2-pyrazoline-5-one, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(l-carbamoyl-3,5-dimethylpyrazole), 1,8-(3,6-dioxaoctane)-bis-(isothiuroniumtrifluoroacetate), and 2-(tribromomethylsulfonyl)benzothiazole; merocyanine dyes (for example, 3-ethyl-5-((3-ethyl-2-benzothiazolinylidene (benzothiazolinylidene))-1-methylethylidene-2-thio-2,4-oxazolidinedione); phthalazinone, phthalazinone derivatives or metal salts thereof (for example, 4-(l-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, combination of 6-chlorophthalazinone and benzenesulfinic acid sodium or combination of 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphtoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

In the thermally developable photosensitive material to which the present invention is applied, employed can be sensitizing dyes described, for example, in Japanese Patent Publication Open to Public Inspection Nos. 63-159841, 60-140335, 63-231437, 63-259651, 63-304242, and 63-15245; U.S. Pat. Nos. 4,639,414, 4,740,455, 4,741,966, 4,751,175, and 4,835,096.

Useful sensitizing dyes employed in the present invention are described, for example, in publications described in or cited in Research Disclosure Items 17643, Section IV-A (page 23, November 1978), 1831, Section X (page 437, August 1978). Particularly, selected can advantageously be sensitizing dyes having the spectral sensitivity suitable for spectral characteristics of light sources of various types of scanners. For example, compounds are preferably employed which are described in Japanese Patent Publication Open to Public Inspection Nos. 9-34078, 9-54409, and 9-80679.

A mercapto compound, a disulfide compound or a thione compound may be applied to the present invention for the purpose of controlling development as inhibited or accelerated, enhancing optical sensitization efficiency or improving storage stability before or after development of the photosensitive material. In cases where the mercapto compound is used in the present invention, any compound having a mercapto group can be used, but preferred compounds are represented by the following formulas, Ar-SM and Ar-S-S-Ar.

In the above-mentioned formulas, M represents a hydrogen atom or an alkaline metal atom, Ar represents an aromatic ring compound or a condensed aromatic ring compound having at least a nitrogen, sulfur, oxygen, selenium or tellurium. Preferable heteroaromatic ring compounds include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazoline. These heteroaromatic ring compounds may contain a substituent selected from a halogen atom (e.g., Br and Cl), a hydroxy group, an amino group, a carboxy group, an alkyl group (e.g., alkyl group having at least a carbon atom, preferably 1 to 4 carbon atoms) and an alkoxy group (e.g., alkoxy group having at least a carbon atom, preferably 1 to 4 carbon atoms). Examples of mercapto-substituted heteroaromatic ring compounds include 2-mercaptobenzimidazole, 2-mercaptobenzoxazole, 2-mercaptobenzothiazole, 2-mercapto-5-methylbenzothiazole, 3-mercapto-1,2,4-triazole, 2-mercaptoquinoline, 8-mercaptopurine, 2,3,5,6-tetrachloro-4-pyridinethiol, 4-hydroxy-2-mercaptopyrimidine and 2-mercapto-4-phenyloxazole.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 30 percent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc.

Regarding organic substances, as organic matting agents those can be employed which is starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed.

The size of a matting agent is expressed in the diameter of a sphere which has the same volume as the matting agent. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below.

(Standard deviation of grain diameter)/(average grain diameter)×100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface. Addition methods of the matting agent include those in which a matting agent is previously dispersed into a coating composition and is then coated, and prior to the completion of drying, a matting agent is sprayed. When a plurality of matting agents are added, both methods may be employed in combination.

In the present invention, in order to improve electrification property of the thermally developable photosensitive material, electrically conductive compound such as a metal oxide and/or an electrically conductive polymer can be incorporated into a photographic component layer. These compounds can be incorporated into any of the photographic component layer. These compounds may preferably be incorporated into a sublayer, a backing layer, and a layer between a photosensitive layer and a sublayer. The electrically conductive compounds preferably used in the present invention are described in U.S. Pat. No. 5,244,773, on columns 14 through 20.

Various additives may be incorporated into any of the photosensitive layers, non-photosensitive layers, and other composition layers. Incorporated into the thermally developable material of the present invention may be incorporated additives other than those described above, such as surface active agents, antioxidants, stabilizers, plasticizers, UV absorbers, coating aids, etc. Preferably employed as these additives, as well as those described above, may be compounds described in Research Disclosure Item 17029 (pages 9 to 15, June 1978).

Binders suitable for the thermally developable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile), copoly(styrene-butadiene), poly(vinyl acetal) series [for example, poly(vinyl formal) and poly(vinyl butyral)], poly(ester) series, poly(urethane) series, phenoxy resins, poly(vinylidene chloride), poly (epoxide) series, poly(carbonate) series, poly(vinyl acetate) series, cellulose esters, poly(amide) series. These may be hydrophilic or hydrophobic. However, in the present invention, the binder is preferably transparent to reduce fogging after thermal development. As the preferable binder, are cited poly(vinyl butyral), cellulose acetate, cellulose acetatebutylate, polyester, polycarbonate, polyacrylic acid, polyurethane, etc. Of these, poly(vinyl butyral), cellulose acetate, cellulose acetatebutylate and polyester are preferably employed. They may be hydrophilic or hydrophobic.

Furthermore, in order to protect the surface of photosensitive materials as well as to minimize abrasion thereof, non-photosensitive layers may be provided on the outside of photosensitive layers. Binders employed in such non-photosensitive layers may be the same type as those employed in the photosensitive layers or may be different.

In the present invention, in order to enhance the rate of thermal development and appropriate density, the amount of binders in a photosensitive layer is preferably 1.5 to 10 g/m$^2$, and is more preferably 1.7 to 8 g/m$^2$.

Supports employed in the present invention are preferably, in order to obtain predetermined optical density after development processing and to minimize the deformation of images after development processing, plastic films (for example, polyethylene terephthalate, polycarbonate, polyimide, nylon, cellulose triacetate, polyethylene naphthalate).

Of these, as preferred supports, listed are polyethylene terephthalate (hereinafter referred to as PET) and other plastics comprising styrene series polymers having a syndiotactic structure (hereinafter referred to as SPS). The thickness of the support is about 50 to about 300 $\mu$m, and is preferably 70 to 180 $\mu$m.

Furthermore, thermally processed plastic supports may be employed. As acceptable plastics, those described above are listed. The thermal treatment of the support, as described herein, is that after film casting and prior to the photosensitive layer coating, these supports are heated to a temperature at least 30° C. higher than the glass transition point by not less than 30° C. and more preferably by at least 40° C.

Plastics employed in the present invention are described below.

PET is a plastic in which all the polyester components are composed of polyethylene terephthalate. However, other than polyethylene terephthalate, employed also may be polyesters in which modified polyester components such as acid components, terephthalic acid, naphthalene-2,6-dicaroxylic acid, isophthalic acid, butylenecarboxylic acid, 5-sodiumsulfoisophthalic acid, adipic acid, etc., and as glycol components, ethylene glycol, propylene glycol, butanediol, cyclohexane dimethanol, etc. may be contained in an amount of no more than 10 mole percent, with respect to the total polyester content.

SPS is different from normal polystyrene (atactic polystyrene) and a polystyrene having stereoregularity. The stereoregular structure portion of SPS is termed a racemo chain and the more regular parts increase as 2 chains, 3 chains, 5 chains or more chains, the higher being, the more preferred. In the present invention, the racemo chains are preferably not less than 85 percent for two chains, not less than 75 percent for three chains, not less than 50 percent for five chains, and 30 percent for not less than 5 chains. SPS can be polymerized in accordance with a method described in Japanese Patent Publication Open to Public Inspection No. 3-131843.

As the base casting method of the support and subbing production method which are associated with the present invention, any of those known in the art can be employed. However, those methods described in paragraphs [0030] through [0070] of Japanese Patent Publication Open to Public Inspection No. 9-50094 are preferably employed.

The thermally developable photosensitive material of the present invention is subjected to thermal development processing to form photographic images. Accordingly, said thermally developable photosensitive material is preferably one which comprises photosensitive silver halides, reducing agents, and if desired, tone modifiers which control silver tone, which are generally dispersed into a (an organic) binder matrix.

The thermally developable photosensitive material of the present invention is stable at normal temperature, however, after exposure, when heated at a relatively high temperature (for example, 80 to 140° C.), it undergoes development. Heating results in an oxidation-reduction reaction between the organic silver salt (which functions as an oxidizing agent) and the reducing agent to form silver. Said oxidation-reduction reaction is accelerated by the catalytic action of the latent image formed on exposed silver halides. An image is formed in such a manner that silver formed through the reaction of the organic silver salt provides a black image which is in contrast to unexposed areas. Said reaction proceeds without the supply of processing solutions, such as water.

The thermally developable material of the present invention comprises a support having thereon at least one photosensitive layer. Said photosensitive layer may be formed only on a support, but at least one non-photosensitive layer is preferably formed on the photosensitive layer. In order to control the light quantity passing through the photosensitive layer or to control the wavelength range, formed may be a filter dye layer on the photosensitive layer side and/or an antihalation layer, a so-called backing layer on the reverse side, and dyes or pigments may be incorporated into the photosensitive layer. Any dyes which show specified absorption in the desired wavelength region may be employed but compounds are preferably employed which are described in, for example, Japanese Patent Publication Open to Public Inspection Nos. 59-6481 and 59-182436; U.S. Pat. Nos. 4,271,263 and 4,594,312; European Patent Publication Open to Public Inspection Nos. 533,008 and 652,473; Japanese Patent Publication Open to Public Inspection Nos. 2-215140, 4-348339, 7-1914323, and 7-301890; etc.

Furthermore, said binders, as well as matting agents, are preferably incorporated into these non-photosensitive layers. Still further, lubricant such as polysiloxane compounds, waxes, and liquid paraffin may also be incorporated.

The photosensitive layer may be composed of plural layers, such as high sensitive layer/low sensitive layer or low sensitive layer/high sensitive layer to control gradation.

In the thermally developable photosensitive material whole amount of silver is 2.4 g/m$^2$ or lower, more preferably 0.5 to 2.4 g/m$^2$, and specifically preferably 1.0 to 2.2 g/m$^2$ as converted silver. Total amount of silver is determined in accordance with the purpose or condition of using. An advantageous photosensitive material can be obtained in such characteristics as sensitivity, fog, and storage stability with the amount described above. As thermally developable photosensitive material to which the processing method of the present invention is applied, those can be employed which are disclosed, as described above, in, for example, U.S. Pat. Nos. 3,152,904 and 3,457,075, and D. Morgan, "Dry Silver Photographic Material" and D. Morgan and B. Shely, "Thermally Processed Silver Systems" (Imaging Processes and Materials) Neblette, 8th Edition, edited by Sturge, V. Walworth, and A. Shepp, page 2, 1969), etc.

These photosentive materials are developed at high temperature of 80 to 140° C. to form an image and no fixing processing is required in the presnt invention. Therefore, the unreacted silver halide and organic silver at unexposed portion remain in the photosensitive material without being removed.

In the present invention, the optical transmission density of a photosensitive material including the support, which has been processed, is preferably no more than 0.2 at 400 nm. The optical transmission density is more preferably 0.02 to 0.2. At an optical transmission density of less than 0.02, occasionally, the photosensitive material may not be put into practical use due to low sensitivity.

Listed as solvents employed in the present invention, are, for example, as ketones, acetone, isophorone, ethyl amyl ketone, methyl ethyl ketone, methyl isobutyl ketone, etc. Listed as alcohols are methyl alcohol, ethyl alcohol, n-propyl alcohol, isopropyl alcohol, n-butyl alcohol, isobutyl alcohol, diacetone alcohol, cyclohexanol, benzyl alcohol, etc. Listed as glycols are ethylene glycol, diethylene glycol, triethylene glycol, propylene glycol, hexylene glycol, etc. Listed as ether alcohols are ethylene glycol monomethyl ether, diethylene glycol monoethyl ether, etc. Listed as ethers are ethyl ether, dioxane, isopropyl ether, etc.

Listed as esters are ethyl acetate, butyl acetate, isopropyl acetate, etc. Cited as hydrocarbons are n-pentane, n-hexane, n-heptane, cyclohexane, benzene, toluene, xylene, etc. Chlorides may be methyl chloride, methylene chloride, chloroform, dichlorobenzene, etc. Cited as amines are monomethylamine, dimethylamine, triethanolamine, ethylenediamine, triethylamine, etc. Listed as others are water, formamide, dimethylformamide, nitromethane, pyridine, toluidine, tetrahydrofuran, acetic acid, etc. However, the present invention is not limited to the above, and in addition, these solvents may be employed individually or in combination.

Further, the content of the above-mentioned solvents in a photosensitive material may be adjusted depending on variations in conditions such as temperature conditions in the drying process after the coating process etc. Furthermore, the content of said solvents may be measured by gas chromatography under suitable conditions to detect contained solvents.

The content of the total solvents contained in the thermally developable photosensitive material of the present invention is preferably 5 to 1000 mg/m$^2$, and is more preferably 10 to 300 mg/m$^2$. When the content of the solvents is in the above-mentioned range, it is possible to obtain a thermally developable material which exhibits high sensitivity as well as low fog density.

In the present invention, exposure is preferably carried out employing laser beam scanning. At the time, it is preferred to employ a laser scanning exposure device in which the exposed surface of the photosensitive material is substantially not perpendicular to the laser beam.

"Is substantially not perpendicular to" as described herein means that during laser scanning, the angle which is nearest to being perpendicular is preferably 55 to 88 degrees, is more preferably 65 to 84 degrees, and is most preferably 70 to 82 degrees.

When a photosensitive material is subjected to laser beam scanning, the beam spot diameter on the surface of the photosensitive material is preferably no more than 200 $\mu$m, and is more preferably no more than 100 $\mu$m. The decrease in the spot diameter is preferred so that difference of the incident angle of the laser beam from the right angle is decreased. Further, the lower limit of the beam spot diameter is 10 μm. By carrying out such a laser scanning exposure, may be minimized the deterioration of image quality due to reflected light such as the generation of unevenness due to an interference mottle etc.

Furthermore, the exposure in the present invention is preferably carried out employing a laser scanning exposure device which emits a longitudinal multiple scanning laser beam, which minimizes the generation of unevenness due to an interference fringe etc., compared to a longitudinal single-mode scanning laser beam. In order to generate the longitudinal multiple laser beam, methods are preferably employed in which a return beam due to multiplexing is employed, or high frequency superimposition is applied, etc. Further, the "longitudinal multiple" means that the wavelength of exposure light is not single, and the range of normal exposure wavelength is at least 5 nm and is preferably at least 10 nm. The upper limit of the wavelength of exposure light is not specifically limited, however generally, it is approximately 60 nm.

EXAMPLES

The present invention will be described below with reference to examples.

Example 1

(Preparation of Support)

A blue-tinted sheet of 175 μm thick PET film having a density of 0.170 (measured by a densitometer PDA-65 manufactured by Konica Corp.) was subjected to corona discharge treatment of 8 W/m$^2$ on both surfaces.

(Backing Coating)

While agitating 830 g of methylethylketone (MEK), 84.2 g of cellulose acetate butylate (CAB381-20, product by Eastman Chemical Co.) and 4.5 g of polyester resin (Vitel PE2200B, product by Bostic Co.) were added and dissolved in MEK. To the dissolved solution 0.30 g of infrared dye-1 was added, and further, 4.5 g of fluorine surfactant (Surfron KH40, product by Asahi Glass Co., Ltd.) and 2.3 g of fluorine surfactant (Megafac F120K, product by Asahi Glass Co., Ltd.) dissolved in 43.2 g of methanol were added and agitated well until dissolving. Finally, 75 g of dispersion of silica (Siloid 64X6000, product by W. R. Grace Co.) dispersed in 1 wt % concentration in MEK by means of dissolver type homogenizer was added to prepare coating composition for back coat.

Thus obtained back coat coating composition was applied so as to form dry thickness of 3.5 μm by means of extrusion coater. It was subjected for 5 minutes with drying air of dry point at 100° C. and due point 10° C.

(Preparation of Silver Halide Photosensitive Emulsion A)

| | |
|---|---|
| A1 | |
| Phenylcarbamoyl modified gelatin | 88.3 g |
| Compound (A) 10% methanol solution | 10 ml |
| Potassium bromide | 0.32 g |
| Water to make | 5,429 ml. |
| B1 | |
| Aqueous solution of silver nitrate (0.67N) | 2,635 ml |
| C1 | |
| Potassium bromide | 51.55 g |
| Potassium iodide | 1.47 g |
| Water to make | 660 ml. |

-continued

| | |
|---|---|
| D1 | |
| Potassiuin bromide | 154.9 g |
| Potassium iodide | 4.41 g |
| Iridium chloride 1% aqueous solution | 0.93 ml |
| Water to make | 1,982 ml |
| E1 | |
| Potassium bromide, 0.4N in an amount to control Ag potential (pAg) described below | |
| F1 | |
| Potassium hydroxide | 0.71 g |
| Water to make | 20 ml |
| G1 | |
| Acetic acid 56% aqueous solution | 18.0 ml |
| H1 | |
| Sodium carbonate anhydride | 1.72 g |
| Water to make | 151 ml. |

Compound (A): $HO(CH_2CH_2O)n\text{-}(CH(CH_3)CH_2O)17\text{-}(CH_2CH_2O)mH$
m + n = 5 to 7

To A1 one fourth amount of B1 and all of C1 were added taking 4 minutes 45 second and controlling temperature at 45° C. and pAg of 8.09 by simultaneous mixing method employing mixing agitator described in Japanese Patent Publication Nos. 58-58288 and 58-58289 to form nuclear grains. After one minute all of F1 was added.

After 6 minutes remaining amount of B1 and all of D1 were added taking 4 minutes 15 second and controlling temperature at 45° C. and pAg of 8.09 by simultaneous mixing method. After 5 minutes agitation it was cooled to 40 ° C., then all of D1 was added whereby silver halide grains were precipitated. Supernatant liquid was removed remaining precipitated part 2000 ml, then 10 1 of water was added. After agitation silver halide grains were precipitated. Supernatant was removed remaining 1500 ml of precipitated part, then 10 l of water was added, after agitation, silver halide emulsion was precipitated. After removing supernatant remaining 1500 ml of precipitated part, H1 was added and temperature was elevated to 60° C., further agitation was continued for 120 minutes. Finally, pH was adjusted to 5.8, water was added in an amount to make 1161 g per one mol Ag to obtain photosensitive silver halide emulsion A.

Thus monodispersed grain distributed cubic silver iodobromide grains having an average grain size of 0.058 μm, a grain size variation coefficient of 12 percent, and a [100] plane ratio of 92 percent were obtained.

(Preparation of Organic Silver Salt Powder A)

Dissolved in 4,720 ml of deionized water were, at 80° C., 111.4 g of behenic acid, 83.3 g of arachidic acid, and 54.9 g of stearic acid. Subsequently, 540.2 ml of a 1.5 M aqueous sodium hydroxide solution were added while stirring at a high speed. After adding 6.9 ml of concentrated nitric acid, the resulting mixture was cooled to 55° C. to obtain a fatty acid sodium salt. While maintaining the resulting fatty acid sodium salt solution at 55° C., 45.3 g of the above-mentioned silver halide emulsion and deionized water 450 ml were added, and the resulting mixture was stirred for 5 minutes.

Next, 702.6 ml of a 1 M silver nitrate solution was added over 2 minutes and further stirred for 10 minutes. Water-soluble salts were then removed by filtration. Thereafter, the resulting product was repeatedly washed with deionized water until the electrical conductivity of the filtrate reached 2 μS/cm, and was subjected to centrifugal dehydration, and was dried employing heated air until no decrease in weight occurred. Thus, an organic silver salt powder A was obtained.

(Preparation of Organic Silver Salt Powder B)

Dissolved in 4,720 ml of deionized water were, at 90° C., 217.6 g of behenic acid, 28.2 g of arachidic acid, and 6.4 g of stearic acid. Subsequently, 93.3 ml of a 4N aqueous sodium hydroxide solution was added and the resulting mixture was cooled to 40° C. to obtain a fatty acid sodium salt. While maintaining the resulting fatty acid sodium salt solution at 40° C., 45.3 g of the above-mentioned silver halide emulsion and deionized water 450 ml were added, and the resulting mixture was stirred for 5 minutes. Organic silver salt powder B was prepared in the same procedure as Organic Silver Salt Powder A in the later stage.

(Preparation of Preliminary Dispersion A)

Dissolved in 1457 g of methyl ethyl ketone were 14.57 g of a polyvinyl butyral powder (Butvar B-79, Monsanto Co.), and while stirring the resulting mixture employing a Dissolver type homogenizer, 500 g of organic silver salt powder A were gradually added and was well blended to prepare preliminary dispersion A.

(Preparation of Preliminary Dispersion B)

Preliminary dispersion B was prepared employing organic silver salt B in the same way as preliminary dispersion A.

(Preparation of photosensitive emulsion 1)

The preliminary dispersion A was dispersed at a circumferential speed of 13 m/sec. for a mill retention time of 10 minutes, employing a media type homogenizer (manufactured by Gettzmann Co.) which was filled 80 percent of inner content with 0.5 mm diameter Zr beads (Torayceram, manufactured by Toray Co.) to prepare photosensitive emulsion 1.

(Preparation of Photosensitive Emulsion 2)

The preliminary dispersion A was dispersed at a circumferential speed of 13 m/sec. for a mill retention time of 3 minutes, employing the same homogenizer as preparation of photosensitive emulsion 1. The obtained dispersion was dispersed by passing pressure type homogenizer GM-2 (manufactured by SMT Co.) once at 560 kgf/cm$^2$ to obtain the photosensitive emulsion 2.

(Preparation of Photosensitive Emulsion 3)

The preliminary dispersion A was dispersed at a circumferential speed of 13 m/sec. for a mill retention time of 0.7 minutes, employing the same homogenizer as preparation of photosensitive emulsion 1. The obtained dispersion was dispersed by passing pressure type homogenizer GM-2 (manufactured by SMT Co.) once at 560 kgf/cm to obtain the photosensitive emulsion 3.

(Preparation of Photosensitive Emulsion 4)

The preliminary dispersion A was dispersed at a circumferential speed of 13 m/sec. for a mill retention time of 3 minutes, employing the same homogenizer as preparation of photosensitive emulsion 1 to obtain dispersion photosensitive emulsion 4.

(Preparation of Photosensitive Emulsion 5)

The preliminary dispersion A was dispersed at a circumferential speed of 13 m/sec. for a mill retention time of 0.7 minutes, employing the same homogenizer as preparation of photosensitive emulsion 1 to obtain dispersion photosensitive emulsion 5.

(Preparation of Photosensitive Emulsion 6)

The preliminary dispersion A was dispersed by passing pressure type homogenizer GM-2 (manufactured by SMT Co.) twice at 280 kgf/cm$^2$ for the first time and 560 kgf/cm$^2$ for the second time to obtain the photosensitive emulsion 6.

(Preparation of Photosensitive Emulsion 7)

The preliminary dispersion A was dispersed at a circumferential speed of 8 m/sec. for a mill retention time of 0.7 minutes, employing the same homogenizer as preparation of photosensitive emulsion 1 to obtain dispersion photosensitive emulsion 7.

(Preparation of Photosensitive Emulsion 8)

The preliminary dispersion B was dispersed at a circumferential speed of 13 m/sec. for a mill retention time of 3 minutes, employing the same homogenizer as preparation of photosensitive emulsion 1 to obtain dispersion photosensitive emulsion 8.

(Preparation of Photosensitive Emulsion 9)

The preliminary dispersion B was dispersed by passing pressure type homogenizer GM-2 (manufactured by SMT Co.) twice at 280 kgf/cm$^2$ for the first time and 560 kgf/cm$^2$ for the second time to obtain the photosensitive emulsion 9.

Each of photosensitive emulsion 1 to 9 has at least 80% of organic silver salt grains having aspect ratio of not less than 3 based on all organic silver salt grains in each emulsion.

<Preparation of Stabilizer Solution>

Dissolved in 4.97 g of methanol were 1.0 g of a stabilizer and 0.31 g of potassium acetate to prepare a stabilizer solution.

<Preparation of Infrared Sensitizing Dye Solution>

In a dark room, 19.2 mg of infrared sensitizing dye 1, 1.488 g of 2-chloro-benzoic acid, and 2.799 g of Stabilizer 2 and 365 mg of 5-methyl-2-mercaptobenzimidazole were dissolved in 31.3 ml of MEK to prepare an infrared sensitizing dye solution.

<Preparation of Additive Solution a>

Reducing agent A-3 in an amount of 27.98 g, 1.54 g of 4-methylphthalic acid and 0.48 g of infrared dye 1 were dissolved in 110 g of methyl ethyl ketone (MEK) to prepare the Additive Solution a.

<Preparation of Additive Solution b>

Antifoggant 2 in an amount of 3.56 g and 3.43 g of phthalazine were dissolved in 40.9 g of MEK to prepare the additive solution b.

<Preparation of Photosensitive Layer Coating Composition>

The above-mentioned photosensitive emulsion 1 (50 g) and 15.11 g of MEK were maintained at 21° C. while stirring; 390 μl of antifoggant 1 (10% methanol solution) was added to the resulting mixture and was stirred for one hour. Further, 494 μl of calcium bromide (10% methanol solution) was added and stirred for 20 minutes. Subsequently, 167 mg of the Stabilizing Solution was added and stirred for 10 minutes and then 2.622 g of Infrared sensitizing Dye Solution was added and stirred for one hour. Thereafter, the resulting mixture was cooled to 13° C. and was further stirred for 30 minutes. While maintaining the temperature at 13° C., 13.31 g of polyvinyl butyral (Butvar B-79, Monsanto Co.) was added and was stirred for 30 minutes then 1.084 g of tetrachlorophthalic acid (9.4 wt % MEK solution) was added and stirred for 15 minutes. Subsequently, while keeping stirring, 12.43 g of Additive Solution a, 1.60 ml of aliphatic isocyanate (10% MEK solution, Desmodur N3300, Mobay Co) and 4.27 g of Additive Solution b were added in this order and stirred to obtain photosensitive layer coating composition.

<Preparation of Matting Agent Dispersion>

In 42.5 g of MEK 7.5 g of cellulose acetatebutylate (CAB171-15, Eastman Chemical) was dissolved, into the resulted 5 g of solution calcium carbonate (Super-Pflex 200, Specialty Minerals Co.) and the resultant was dispersed by means of dissolver type homogenizer at 8,000 rpm for 30 minutes to obtain the matting agent dispersion.

<Preparation of Coating Composition for Surface Protective Layer>

Stirring 865 g of MEK, 96 g of cellulose acetatebutylate (CAB171-15, Eastman Chemical), 4.5 g of polymethylmethacryric acid (Paraloid, A-21, Rohm & Haas Co.), 1.5 g of vinylsulfon compound HD-1, 1.0 g of benztriazole and fluoride surfactant (Surflon KH40, Asahi Glass Co., Ltd.) were added and dissolved. Subsequently 30 g of Matting agent dispersion was added and stirred to obtain the coating composition for surface protective layer.

Infrared sensitizing dye 1

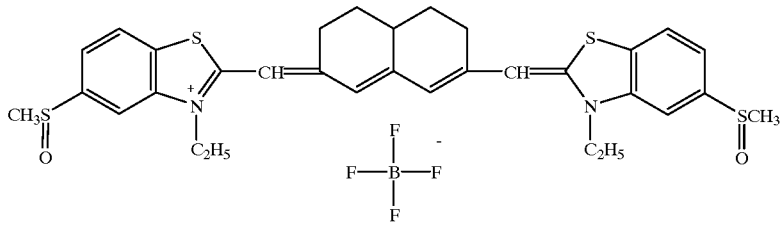

Stabilizer 1

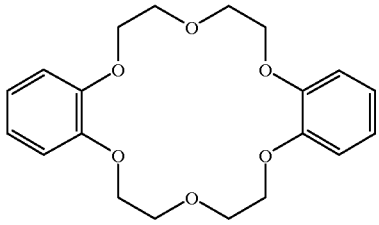

Antifoggant 1

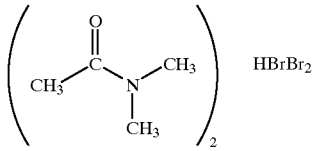

Antifoggant 2

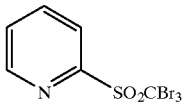

Infrared dye 1

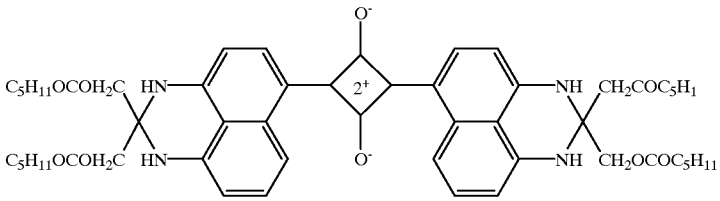

Vinylsulfon compound (HD-1)

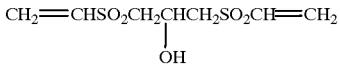

Stabilizer 2

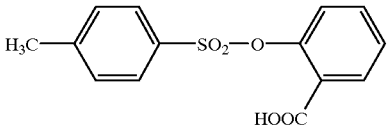

<Photosensitive Side Coating>

Photosensitive material 1 was prepared by coating the above-mentioned coating composition and the coating composition for surface protective layer simultaneously employing extruding coater. Coating was conducted so as to obtain a coated silver amount of 1.9 g/m$^2$ for photosensitive layer and dry thickness of 2.5 $\mu$m for the surface protective layer. The coated material was dried with drying air of dry point of 75° C. and due point of 10° C. for 10 minutes.

Photosensitive materials 2 to 9 were prepared in the same way employing photosensitive emulsions 2 to 9 in place of the photosensitive emulsion 1.

<Exposure and Photographic Processing>

The emulsion surface of the photosensitive material prepared as described above was subjected to laser scanning exposure employing an exposure device which used, as an exposure light source, a longitudinal multiple mode semiconductor laser of wavelengths of 800 to 820 nm at high frequency superimposition. At the time, images were prepared at an angle of 75 degrees between the exposed surface of the photosensitive material and the exposure laser beam (further, excellent images with less unevenness and unexpectedly higher sharpness were obtained compared to cases in which said angle was 90 degrees).

Thereafter, the exposed photosensitive material was thermally developed at 110° C. for 15 seconds employing an automatic processor having a heat drum so that the protective layer of the photosensitive material was brought into contact with the surface of the drum. Exposure, as well as development, was carried out in a room controlled at 23° C. and RH 50 percent. The density of obtained images was measured by a densitometer to obtain sensitivity (the inverse of the ratio of exposure amount which gives 1.0 higher density than the unexposed area) and fog. Table 1 shows sensitivities when the sensitivity of photosensitive material 1 is 100.

<Evaluation of Degree of Monodisperse>

The dispersion was diluted to 1,000 times and dispersed on a grid having carbon support membrane with hydrophilic treatment and was pictured by a TEM (a transmission electron microscope), was a Type JEM-2000FX manufactured by Nippon Denshi Co. at an acceleration voltage of 200 kV, at a direct magnification of 5,000. In this instance the sample holder was cooled to −120° C. to protect the sample from damage. Negative image was converted to a digital image through a scanner, circle equivalent diameter of over 300 grains (shown in Table 1) was observed by employing image processing software and average value and variation coefficient were calculated.

<Evaluation of Zr Content>

A sample film sheet was cut to 10×10 cm and the photosensitive layer was peeled off employing MEK. The peeled layer underwent sulfuric nitric acid decomposition employing a Microdigest Type A300 Microwave Wet Type Decomposition Apparatus (manufactured by Prolab Co.), and was analyzed by a calibration curve method employing an inductive coupling plasma mass spectrometer, Type PQ-Ω ICP-MS (manufactured by VG Elemental Co.). Table 1 shows the results.

<Determination of Solvent Content in Film>

A film sheet was cut to 46.3 m$^2$ and was further cut into pieces having a length of about 5 mm. These pieces were put in a special vial which was tightly sealed employing a septum and an aluminum cap. Thereafter, the vial was set in a Head Space Sampler Type HP7694, manufactured by Hewlett Packard Co.

A gas chromatograph (GC: Type 5971 manufactured by Hewlett Packard Co.) connected to the Head Space Sampler was equipped with a hydrogen flame ion detector (FID) as a detector. Main measurement conditions are described below.

Heating conditions of the Head Space Sampler: 120° C. and 20 minutes

GC introduction temperature: 150° C.

Column: DB-624 manufactured by J&W Co.

Temperature elevation: maintained at 45° C. for 3 minutes and then elevated to 100° C. (at 8° C./minute)

Under the measurement conditions as described above, gas chromatograms were obtained. Solvents employed for measurements were MEK and methanol. After placing into the special vials in definite amounts for each sample, which was prepared by diluting MEK or methanol with butanol, a calibration curve was prepared employing the peak area in the chromatogram of each sample, measured in the same manner as described above. Employing the obtained calibration curve, the solvent content in each film was calculated.

<Evaluation of Average of needle Ratio of Organic Silver Salt Grains>

Samples were prepared employing a Type JFD-7000 (manufactured by Nippon Denshi Co.) as a vacuum deposition device. Type S-5000H (manufactured by Hitachi, Ltd.), was employed as an FE-SEM, and each sample was observed at an acceleration voltage of 2.0 kV in such a manner that a visual field was selected in which at least 1,000 organic silver grains were present. Each image was digitized, transmitted to a filling device (VIDEO BANK), and stored in an MO disk. Subsequently, employing Type LUZEX-III (manufactured by Nireko Co.), and manual operation when grains were overlapped or in contact with each other, each grain was extracted and its MX LNG/WIDTH was measured, by which the average was obtained. Table 1 shows the results.

TABLE 1

| Photo-sensitive Material | Sensitivity | Fog | Number of Measured Organic silver Salt Grains | Average of needle Ratio | Zr Content (mg) (per g of silver in photo-sensitive layer) | Solvent Content (mg/m$^2$) | Degree of disperse |
|---|---|---|---|---|---|---|---|
| 1 | 100 | 0.25 | 1018 | 1.5 | 1.00 | 32 | 19 |
| 2 | 100 | 0.23 | 1020 | 2.6 | 0.32 | 32 | 25 |
| 3 | 105 | 0.21 | 1019 | 3.3 | 0.06 | 32 | 28 |
| 4 | 100 | 0.19 | 1022 | 3.5 | 0.32 | 38 | 29 |
| 5 | 98 | 0.21 | 1041 | 3.9 | 0.06 | 40 | 33 |
| 6 | 95 | 0.21 | 1028 | 5.4 | 0.00 | 80 | 38 |
| 7 | 97 | 0.22 | 1009 | 5.6 | 0.04 | 80 | 34 |
| 8 | 90 | 0.25 | 1023 | 8.2 | 0.30 | 85 | 40 |
| 9 | 70 | 0.35 | 1016 | 11.5 | 0.00 | 80 | 46 |

Solvent content in all samples employed in the Example can be regarded as substantially the same and the solvent content is within range which does not affect to photographic characteristics.

Table 1 clearly shows that samples of the present invention material 1–8 are photosensitive materials which exhibit sufficient sensitivity as well as low fog compared to the comparative sample material 9.

Example 2

Photosensitive materials 11 to 15 were prepared in the same way as Example 1 except that the dispersion condition was modified below.

(Preparation of Photosensitive Emulsion 11)

The preliminary dispersion A was supplied to a media type dispersion machine, DISPERMAT SL-C12EX (manufactured by VMA-GETZMANN Co.) which was filled 80 percent of inner content with 0.5 mm diameter zirconia beads (Torayceram, manufactured by Toray Co.) employing a pump so as to be a mill retention time of 3 minutes and dispersing was conducted at a circumferential speed of 13 m/sec to prepare photosensitive emulsion 11.

(Preparation of Photosensitive Emulsion 12)

The preliminary dispersion A was dispersed by passing pressure type homogenizer GM-2 (manufactured by SMT Co.) twice at 280 kgf/cm for the first time and 560 kgf/cm$^2$ for the second time to obtain the photosensitive emulsion 12.

(Preparation of Photosensitive Emulsion 13)

The photosensitive emulsion 13 was prepared in the same way as photosensitive emulsion 11 except that amount of MEK employed in the preparation of the Preliminary Dispersion A was adjusted so that a mill retention time is 3.

(Preparation of Photosensitive Emulsion 14)

The preliminary dispersion A was supplied to a media type dispersion machine, DISPERMAT SL-C12EX (manufactured by VMA-GETZMANN Co.) which was filled 80 percent of inner content with 0.5 mm diameter zirconia-reinforced-alumina beads (Toraybeads, manufactured by Toray Co.) employing a pump so as to be a mill retention time of 3 minutes and dispersing was conducted at a circumferential speed of 13 m/sec to prepare photosensitive emulsion 14.

(Preparation of Photosensitive Emulsion 15)

The preliminary dispersion B was supplied to a media type dispersion machine, DISPERMAT SL-C12EX (manufactured by VMA-GETZMANN Co.) which was filled 80 percent of inner content with 0.5 mm diameter zirconia-reinforced-alumina beads (Torayceram, manufactured by Toray Co.) employing a pump so as to be a mill retention time of 0.5 minutes and dispersing was conducted at a circumferential speed of 13 m/sec to prepare photosensitive emulsion 15.

Each photosensitive emulsion 10 to 15 has at least 80% of organic silver salt grains with aspect ratio of not less than 3 based on all organic silver salt grains in each emulsion.

<Evaluation of projection Area of the Organic Silver Salt Grains>

An intercept perpendicular to the support was prepared employing a microtome (Ultratome NOVA, manufactured by LKB Co.), and each sample was observed at an acceleration voltage of 200 kV in such a manner that a visual field was selected in which at least 1,000 organic silver grains were present. Negative image was converted to a digital image with resolution 600 dpi through a scanner, and was subjected by image processing employing Type LUZEX-III (manufactured by Nireko Co.), and histogram of projection area of grains were generated, subsequently ratio of grains having projection area of not more than 0.025 $\mu m^2$ and ratio of grains having projection area of not less than 0.2 $\mu m^2$ were calculated. Table 1 shows the results.

<Evaluation of Image Quality>

The part having a density of 1.0 of each developed sample was observed under a transmission mode and at a magnification of 100 employing a Mitsutoyo optical microscope, and image degradation due to white spots, coagula, and the like was evaluated based on the four criteria described below.

4: excellent image quality exhibiting almost neither white spots nor coagula

3: white spots and coagula were somewhat evident, but the image quality resulted in no problem as a commercially viable product 2: white spots and coagula were evident, and the image quality was at the lowest limit as a commercially viable product 1: many white spots and coagula were evident, resulting in unavailable commercial product The result of degree of monodisperse, sensitivity, fog, content of solvent and content of zirconia tested in the same way as Example 1 is shown in Table 2.

TABLE 2

| Photo-sensitive Material | Sensitivity | Fog | Image quality | Number Average of Needle Ratio | Number of Measured Organic silver Salt Grains | Ratio of number of grains having projection area not more than 0.025 $\mu m^2$ (%) | Ratio of number of grains having projection area not less than 0.2 $\mu m^2$ (%) | Zr Content (mg) (per g of silver in photo-sensitive layer) | Solvent Content (mg/m$^2$) | Degree of disperse |
|---|---|---|---|---|---|---|---|---|---|---|
| 11 | 100 | 0.19 | 4 | 3.5 | 1078 | 80 | 9 | 0.32 | 32 | 19 |
| 12 | 93 | 0.23 | 3 | 5.4 | 1062 | 65 | 20 | 0 | 80 | 28 |
| 13 | 97 | 0.21 | 3 | 5.4 | 1050 | 65 | 20 | 0.28 | 75 | 29 |
| 14 | 93 | 0.22 | 3 | 5.4 | 1021 | 62 | 25 | 0.04 | 90 | 32 |
| 15 | 70 | 0.35 | 2 | 10.1 | 1032 | 40 | 32 | 0.04 | 85 | 40 |

It has thus become possible to provide a thermally developable photosensitive material which exhibits high sensitivity, as well as low fog, and an image forming method employing the same.

What is claimed is:

1. A thermally developable photosensitive material having a photosensitive layer comprising a photosensitive silver halide, an organic silver salt of a long chain aliphatic carboxylic acid, said long chain having 10 to 30 carbon atoms, a reducing agent and a binder, wherein the organic silver salt comprises tabular organic silver salt grains having an aspect ratio of not less than 3, and average of needle ratio of the tabular organic silver salt grains measured from principal plane direction is not less than 1.1 and less than 10.

2. The thermally developable photosensitive material of claim 1, wherein the organic silver salt comprises at least 80% by number of tabular organic silver salt grains having an aspect ratio of at least 3, and average of needle ratio of the tabular organic silver salt grains measured from principal plane direction is not less than 1.1 and less than 5.0.

3. The thermally developable photosensitive material of claim 2, wherein the aspect ratio of the tabular organic silver salt grains is 3 to 20.

4. The thermally developable photosensitive material of claim 2, wherein the aspect ratio of the tabular organic silver salt grains is 3 to 10.

5. The thermally developable photosensitive material of claim 1 wherein the organic silver salt grains have a projection area, and at least 70 percent of said projected area is no more than 0.025 $\mu m^2$, at least 10 percent of said projected area is at least 0.2 $\mu m^2$, measured in a perpendicular cross section of the support surface of said photosensitive material observed by an electron microscope.

6. The thermally developable photosensitive material of claim 5, wherein the photosensitive layer comprises zirconium in an amount of 0.01 to 0.5 mg per g of silver.

7. The thermally developable photosensitive material of claim 6, wherein the organic silver salt has monodisperse grain size distribution.

8. The thermally developable photosensitive material of claim 7, wherein monodisperse degree of the organic silver salt grains is 1 to 30%.

9. The thermally developable photosensitive material of claim 7, wherein whole amount of silver is 0.5 to 2.4 $g/m^2$.

10. The thermally developable photosensitive material of claim 7, wherein average grain diameter of the organic silver salt is 0.01 to 0.8 $\mu m$.

11. The thermally developable photosensitive material of claim 10, wherein average grain diameter of the organic silver salt is 0.05 to 0.5 $\mu m$.

12. The thermally developable photosensitive material of claim 10, wherein the average grain size of silver halide is 0.01 to 0.1 $\mu m$.

13. The thermally developable photosensitive material of claim 12, wherein the reducing agent is a hindered phenol compound.

14. The thermally developable photosensitive material of claim 1, wherein photosensitive layer comprises zirconium in an amount of 0.01 to 0.3 mg per g of silver.

15. The thermally developable photosensitive material of claim 7, wherein content of the total solvents contained in the thermally developable photosensitive material is 5 to 1000 $mg/m^2$.

16. The thermally developable photosensitive material of claim 15, wherein content of the total solvents contained in the thermally developable photosensitive material is 10 to 300 $mg/m^2$.

17. The thermally developable photosensitive material of claim 5, wherein the organic silver salt is silver salt of long chain aliphatic carboxylic acid, said long chain having 15 to 25 carbon atoms.

18. The thermally developable photosensitive material of claim 17, wherein the organic silver salt is silver behenate, silver arachidate or silver stearate.

19. A photosensitive emulsion comprising a photosensitive silver halide and an organic silver salt of a lone chain aliphatic carboxylic acid, said long chain having 10 to 30 carbon atoms in which the organic silver salt comprises tabular organic silver salt grains having an aspect ratio of not less than 3, and average of needle ratio of the tabular organic silver salt grains measured from principal plane direction is not less than 1.1 and less than 10.

20. The photosensitive emulsion of claim 19 wherein the organic silver salt comprises at least 80% by number of tabular organic silver salt grains having an aspect ratio of at least 3, and average of needle ratio of the tabular organic silver salt grains measured from principal plane direction is not less than 1.1 and less than 5.0.

21. The photosensitive emulsion of claim 20 which comprises zirconium in an amount of 0.01 to 0.5 mg per g of silver.

* * * * *